United States Patent [19]

Melzer et al.

[11] 4,110,113

[45] Aug. 29, 1978

[54] SULFONAMIDO DYE RELEASER IN PHOTOGRAPHIC DYE DIFFUSION TRANSFER

[75] Inventors: Arnfried Melzer; Paul Marx, both of Cologne; Walter Püschel, Leverkusen, all of Fed. Rep. of Germany

[73] Assignee: AGFA-Gevaert Aktiengesellschaft, Leverkusen, Fed. Rep. of Germany

[21] Appl. No.: 807,078

[22] Filed: Jun. 16, 1977

Related U.S. Application Data

[63] Continuation of Ser. No. 547,433, Feb. 6, 1975, abandoned.

[30] Foreign Application Priority Data

Feb. 12, 1974 [DE] Fed. Rep. of Germany ..... 2406664

[51] Int. Cl.[2] ..... G03C 7/00; G03C 5/54; G03C 1/40; G03C 1/10

[52] U.S. Cl. ..... 96/29 D; 96/3; 96/77; 96/99; 96/100 R

[58] Field of Search ..... 96/3, 29 D, 77, 99, 96/100, 73, 56.6

[56] References Cited

U.S. PATENT DOCUMENTS

| | | | |
|---|---|---|---|
| B 351,673 | 1/1975 | Fleckenstein et al. | 96/3 |
| 2,271,238 | 1/1942 | Vittum et al. | 96/56.6 |
| 2,306,410 | 12/1942 | Schinzel | 96/100 |
| 3,384,657 | 5/1968 | Weissberger et al. | 96/3 |
| 3,443,940 | 5/1969 | Bloom et al. | 96/3 |
| 3,734,726 | 5/1973 | Figueras et al. | 96/3 |
| 3,736,136 | 5/1973 | Danhauser et al. | 96/3 |
| 3,751,406 | 8/1973 | Bloom | 96/3 |

*Primary Examiner*—Edward C. Kimlin
*Assistant Examiner*—Richard L. Schilling
*Attorney, Agent, or Firm*—Connolly and Hutz

[57] ABSTRACT

In the photographic dye-diffusion transfer process use is made of dye-giving compounds, which are non diffusing in photographic binder layers, and which during development if oxidized imagewise in accordance with the silver halide developed are split owing to the alkali of the developer composition to release diffusing dyes, which are transferred to an image-receiving layer. The dye-giving compounds have the formula $$Y—NH—Ar—NH—SO_2—X$$

Ar represents an arylene radical such that the group Y—NH— is attached to the group —NH—$SO_2$—X through a chain of $n(n=1,2,3,$ or $4)$ vinylene groups which are part of the arylene radical;

X represents the radical of a dye or dye precursor;

Y represents a —COR or —$SO_2$R radical; and

R represents an alkyl, aryl or heterocyclic group and can constitute part of a second dye moiety.

3 Claims, No Drawings

SULFONAMIDO DYE RELEASER IN PHOTOGRAPHIC DYE DIFFUSION TRANSFER

This application is a continuation of application Ser. No. 547,433, filed Feb. 6, 1975, now abandoned.

This invention relates to a process for the production of photographic images by dye diffusion transfer, and to a photographic material containing new diffusion-resistant dye-giving compounds suitable for use in this process.

Among conventional processes for the production of colored photographic images by dye diffusion transfer, increasing significance is being attached to those based on the use of dye-giving compounds incorporated in diffusion-resistant form, from which diffusible dyes or dye precursor products are split off image-wise during development and transferred to an image-receiving layer.

Dye-giving compounds suitable for this purpose include, for example, the non-diffusing color couplers described in DT-PS No. 1,095,115. During development, these couplers release in diffusible form a preformed dye or a dye produced during coupling by reacting with the oxidation product of a color developer compounds which consists of a primary aromatic amine. The choice of the developer compound required is, of course, limited to color developers.

In addition, reference is made in this connection to the non-diffusible dye-giving compounds described in DT-OS No. 1,930,215 which contain a preformed, latently diffusible dye radical attached to a diffusion-inhibiting radical through a cleavable hydrazone group. These compounds cannot be regarded as color couplers, and it has also been found that the choice of the developer compounds required for liberating the diffusible dye radical is by no means limited to conventional color developers, but black-and-white developers, for example pyrocatechols, can also be effectively used.

In addition, DT-OS No. 1,772,929 discloses non-diffusible colored compounds with a special group which, during development, enter into an oxidizing ring-closing reaction and, in doing so, release a preformed dye radical in diffusible form. The compounds discussed in that Offenlegungsschrift can be divided into two groups. For development, the compounds of the one group require a conventional color developer compound with whose oxidation product they couple and, in a subsequent ring-closing reaction, liberate the preformed dye radical in diffusible form. The compounds of the other group represent silver halide developers which in the oxidized form, are able to enter the aforementioned ring-closing reaction releasing the diffusible dyes, even in the absence of other developer compounds.

Finally, reference is made to the non-diffusible dye-giving compounds disclosed in DT-OS No. 2,242,762. These compounds are sulfonamidophenols and sulfonamidoanilines which, after being oxidized during development, are split under the effect of the developer alkali to release diffusing dyes.

The dye-giving compounds referred to above all work negatively. In other words, in cases where conventional (negatively working) silver halide emulsions are used, the diffusing dye released is distributed image-wise in consistency with the negative silver image produced during development. To produce positive dye images, therefore, it is necessary to use direct positive silver halide emulsions or, alternatively, to apply a suitable reversal process.

The object of the present invention is to provide new non-diffusing dye-giving compounds for the dye diffusion transfer process which, when used in the same quantity as conventional compounds in the layer, give an increased dye yield or, conversely, which enable a smaller quantity of dye-giving compound and a smaller quantity of silver halide to be required for producing the same dye density.

It has now unexpectedly been found that liberation of the sulfonamide group on completion of oxidation is by no means confined to compounds of the kind which contain a hydroxyl group, amino group or alkylamino group in the p-position to the sulfonamide group on the aromatic ring. Instead, also a sulfonamide group or carbonamide group in the o- or p-position has an adequate activating effect upon the ring system.

The present invention relates to a photographic dye diffusion transfer process for the production of colored images, in which a photographic material with at least one photosensitive silver halide emulsion layer and, associated with that layer, a non-diffusing dye-giving sulfonamidoaryl compound which, in oxidized form, is able to release a diffusing dye in an alkaline developer medium, is exposed imagewise and developed with a silver halide developing agent, the silver halide developing agent in oxidized form oxidizing the dye-giving sulfonamidoaryl compound which, as a result of being oxidized, is split by the developer alkali to produce an imagewise distribution of the diffusing dye liberated, distinguished by the fact that the non-diffusing sulfonamidoaryl compound corresponds to the following formula:

$$Y - NH - Ar - NH - SO_2 - X \qquad (I)$$

in which:

Ar represents an arylene radical such that the group Y—NH— is attached to the group —NH—$SO_2$—X through a chain of $n$($n$ = 1,2,3, or 4) vinylene groups which are part of the arylene radical;

X represents the radical of a dye or dye precursor;

Y represents a —COR or —$SO_2$R radical; and

R represents an alkyl group, aryl group or heterocyclic group which may optionally be further substituted.

In the most simple case, the arylene radical Ar represents a phenylene radical, for example a p-phenylene radical. It can also be a polynuclear aromatic group, for example a 4,4'-biphenylene group, a 1,4-naphthylene group, a 1,5-naphthylene group or a 9,10-anthracenylene group. The arylene groups can, of course, contain one or more other substituents to facilitate oxidation of the dye-giving compounds, for example alkyl, alkoxy, aryl or acylamino. Accordingly, the vinylene groups referred to above are groups corresponding to the formula:

$$- CR'=CR'-$$

in which the two radicals R' can be the same of different and represent hydrogen or, for example, one of the aforementioned substituents; alternatively, two radicals R' of the same or different vinyl group can together represent the C-atoms required to complete the arylene group.

The radical R can perform different functions within the scope of the invention. For example, it can be a radical which imparts adequate diffusion resistance to the dye-giving compound. The fact that the radical R is split off during development together with the —CONH— or —$SO_2$—NH— group can also be utilised for coloring in cases where R represents a dye radical. In this case, the radical R is, for example, an aryl group which is further substituted so that it contains a chromophoric group. R can be the same dye radical as X so that, where Y represents —$SO_2R$, the two radicals, which are split off imagewise during development, are identical and, hence, coincide in color. It is clear that, in this case, an increased yield of diffusing dyes is obtained per equivalent of dye-giving compound, compared with conventional dye-giving compounds. However, the dye radicals X and R can also be different in structure and, hence, different in color as well. By suitably selecting the two dye radicals, it is possible in this way to adjust the color and hence obtain any required color. In addition, the radical R can be any group which, if present in diffusing form after splitting off, has a certain activity and whose action is required imagewise, for example as a development inhibitor, stabilizer, silver-salt solvent and the like.

It is pointed out that the dye-giving compounds according to the invention as intact molecules are not intended to diffuse to the layers of the photographic material. To this end, they contain a radical which makes them resistant to diffusion, for example in the radical R. Another method of introducing a diffusion-inhibiting radical into the molecule of the dye-giving compound is to select as the arylene group Ar groups which have already been suitably substituted by a diffusion-inhibiting radical. Whether the diffusion-inhibiting radical is split off during development is not critical, because a quinoid compound with an extremely low tendency towards diffusion is obviously formed from the arylene group.

Dye-giving compounds particularly suitable for the purposes of the invention correspond to the following formula:

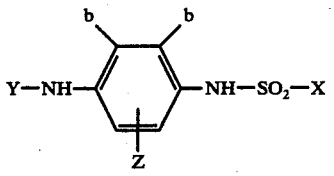

(II)

in which

X and Y are as already defined;

Z represents hydrogen or one or more identical or different substituents, for example alkyl, alkoxy, mono- or di-alkylamino, the alkyl radicals optionally containing up to 20 carbon atoms; aryl, for example phenyl; aroxy, for example phenoxy; acylamino, the acyl radicals being derived from aliphatic or aromatic carboxylic or sulfonic acids; and

*b* represents hydrogen or one of the radicals mentioned in the definition of Z, or the two radicals b together form the radical required to complete a fused aromatic ring system.

It is particularly preferred to use dye-giving compounds corresponding to the following formula:

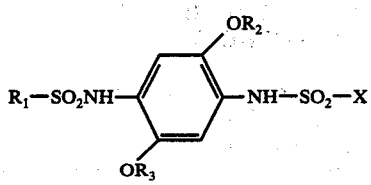

(III)

in which

X is as defined above;

$R_1$ represents a diffusion-inhibiting radical or the radical of a dye or dye precursor, for example the radical X; and $R_2$ $R_3$ are identical or different radicals, i.e. alkyl with up to 20 carbon atoms, preferably with up to 4 carbon atoms.

The dye-giving compounds can themselves be sufficiently resistant to diffusion in cases where Y or $R_1$ represents a dye radical, even when Z (formula II) or $R_2$ and $R_3$ (formula III) do not contain relatively long chain alkyl radicals, because in that case the molecule can be sufficiently large, depending upon the particular dye radical. Alternatively, the dye-giving compounds can be made adequately resistant to diffusion by selecting radicals Z or $R_2$ and $R_3$ of a suitable size.

In the context of the invention, diffusion-inhibiting radicals are radicals of the kind which enable the compounds according to the invention to be incorporated in diffusion-resistant form in the hydrophilic colloids normally used in photographic materials. Preferred radicals of this kind are organic radicals which generally contain linear or branched aliphatic groups and, optionally, isocyclic or heterocyclic aromatic groups with, in general from 8 to 20 carbon atoms as well. These radicals are attached either directly or indirectly, to the rest of the molecule for example through one of the following groups: —NHCO—, —$NHSO_2$—, —NR—, R representing hydrogen or alkyl, —O— or —S—. In addition, the diffusion-inhibiting radical can also contain water-solubilising groups, for example sulfo groups or carboxyl groups which can also be present in anionic form. Since the diffusion properties are governed by the size of the molecule of the whole compound used, it is sufficient in certain cases, for example in cases where the whole molecule used is large enough, to use even shorter-chain radicals as "diffusion-inhibiting radicals".

Basically, suitable dye radicals are the radicals of dyes of any class, providing they are diffusible enough to be able to diffuse through the layers of the photosensitive material into the image-receiving layer. To this end, the dye radicals can be provided with one or more water-solubilizing groups. Suitable water-solubilizing groups are inter alia carboxyl groups, sulfo groups, sulfonamide groups and aliphatic or aromatic hydroxyl groups. However, the sulfonamide group remaining in the dye after splitting itself imparts to the dye molecule a considerable tendency towards diffusion in the alkaline medium, with the result that the presence of additional water-solubilizing groups is not absolutely essential. Examples of dyes particularly suitable for use in the process according to the invention are azo dyes, anthraquinone dyes, phthalocyanine dyes, indigo dyes and triphenylmethane dyes.

In the context of the invention, the radicals of dye precursors are the radicals of compounds of the kind which are converted into dyes during photographic processing by conventional or additional processing stages, whether by oxidation, by coupling or by liberating an auxochromic group in a chromophoric system, for example by hydrolysis. Dye precursors in accordance with this definition can be leuco dyes, couplers or even dyes that are converted into other dyes during processing. Where it is not crucial to distinguish between dye radicals and the radicals of dye precursors, dye precursors are also referred to hereinafter as dye radicals.

The following compounds are examples of dye-giving compounds according to the invention:

Transfer Color

Compound No. 1 — yellow

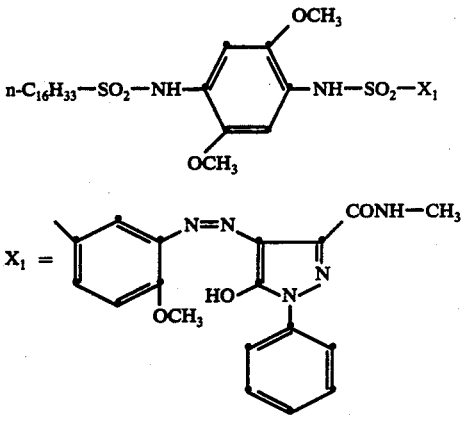

Compound No. 2 — cyan

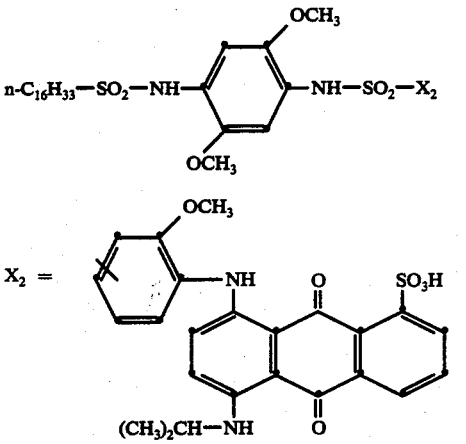

Compound No. 3 — magenta

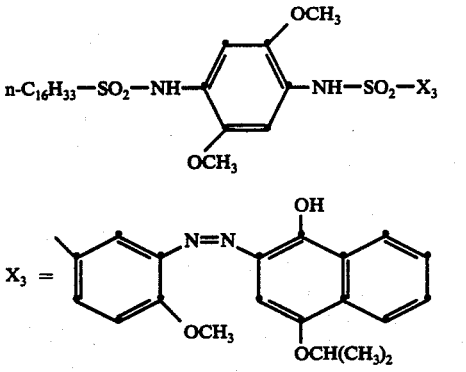

Compound No. 4

-continued

Transfer Color

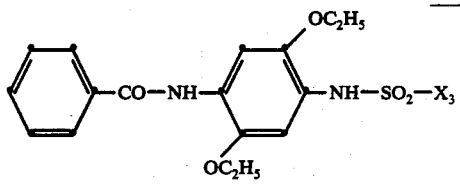

Compound No. 5 — magenta

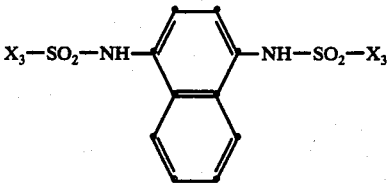

Compound No. 6 — magenta

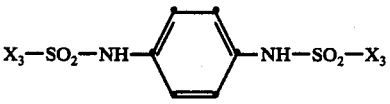

Compound No. 7 — magenta

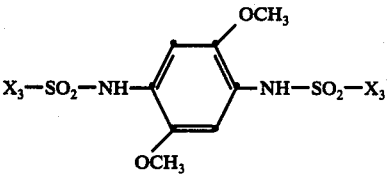

Compound No. 8 — magenta

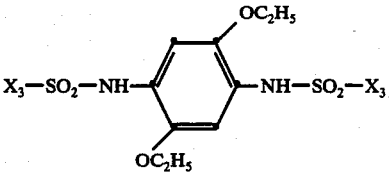

Compound No. 9 — magenta

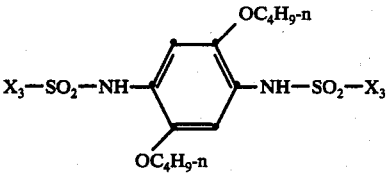

Compound No. 10 — magenta

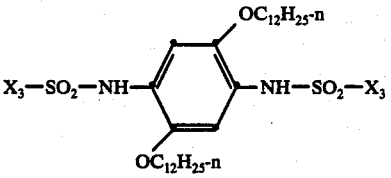

Compound No. 11 — magenta

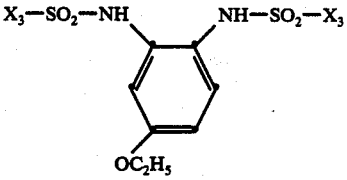

-continued

Transfer Color

Compound No. 12

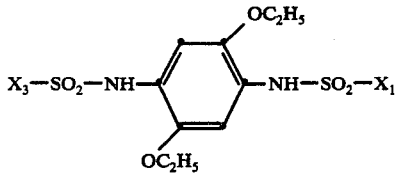

magenta and yellow

Compound No. 13

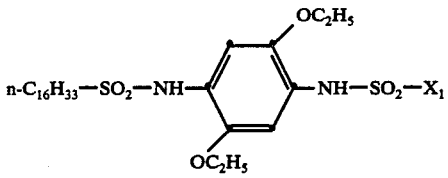

yellow

Compound No. 14

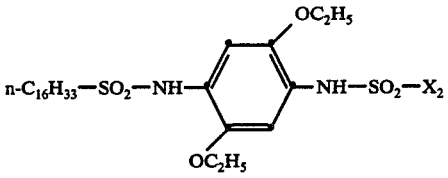

cyan

Compound No. 15

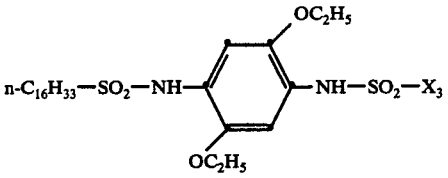

magenta

Compound No. 16

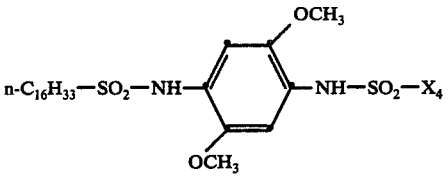

yellow $X_4$ =

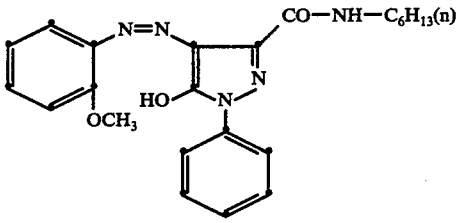

Compound No. 17

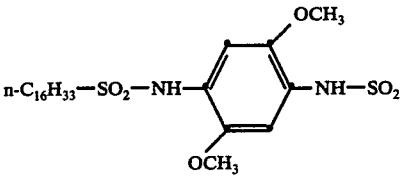

cyan

-continued

Transfer Color $X_5$ =

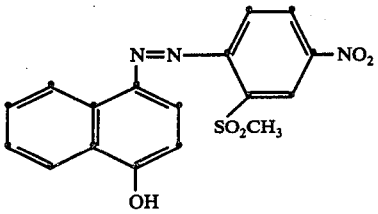

Compound No.18

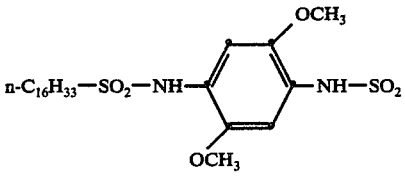

magenta $X_6$ =

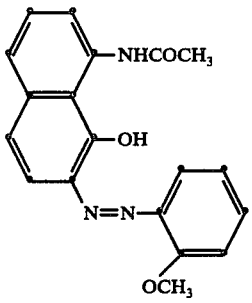

PREPARATION OF THE DYE-GIVING COMPOUNDS ACCORDING TO THE INVENTION

General Procedure

The corresponding arylamine or arylenediamine (or salts thereof, for example the HCl salt) is dissolved or suspended in 5 to 50 times the quantity of anhydrous pyridine. Somewhat more than the theoretically required quantity of the sulfochloride or sulfobromide of the corresponding dye or dye precursor is introduced with stirring at room temperature, a pyridine complex of the sulfohalide being precipitated in some cases. On completion of the reaction, which generally takes a few hours, any undissolved constituents are isolated by filtration under suction and water is slowly added with stirring to the pyridine solution in such a quantity (the volume of water added is generally approximately equal to the volume of pyridine) that the required sulfonamidoaryl compound is precipitated, whilst the sulfonic acid of the dye or dye precursor formed as secondary product remains in solution. After cooling in an ice bath, the product is filtered under suction, washed with pyridine/water and dried, or suspended with a suitable low-boiling water-miscible organic solvent such as, for example, acetonitrile, filtered under suction again and then dried.

If the reaction is followed by thin-layer chromatography, it can be seen that the two amino groups of arylene diamines react one after another. As a result, it is possible to introduce two different radicals into the compound. Example: Preparation of compound No. 12.

11.2 g of the dye sulfochloride A are added in portions with thorough stirring to 3.9 g of 2,5-diethoxy-1,4-phenylene diamine in 50 ml of dry pyridine. The mixture is stirred for a few hours, filtered under suction and water is added with stirring to the clear filtrate in such a quantity that the intermediate product B is precipitated. The precipitate is filtered under suction, washed with water and dried. Yield: 8.8 g, Mp. 233°–235° C. (decomposition).

3.4 g of the dye sulfochloride C are added in portions with thorough stirring to 3.2 g of B in 50 ml of dry pyridine. After stirring for several hours, water is added with stirring to the reaction solution in such a quantity that compound No. 12 is precipitated. This compound is filtered under suction, washed with water and dried. Yield: 4.3 g, Mp. 265°–266° C. (decomposition). Compound No. 12 can be purified by column chromatography using Merck's silica gel 60 (grain size 0.063–0.200 mm); eluent chloroform.

There is no need to isolate the intermediate product B as described above. In this case, the dye sulfochloride C is directly added to the filtered pyridine reaction solution of the dye sulfochloride A with 2,5-diethoxy-1,4-phenylene diamine.

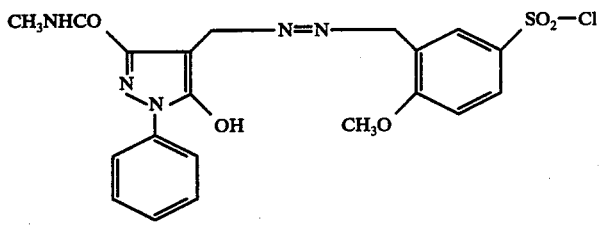

A

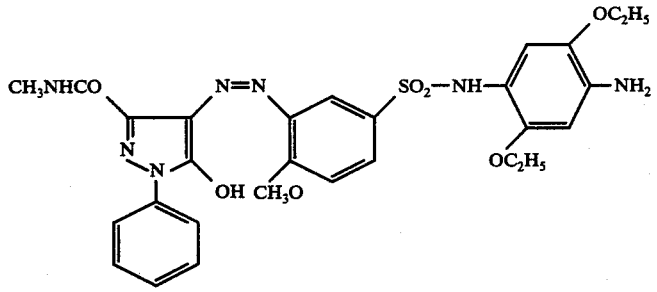

B

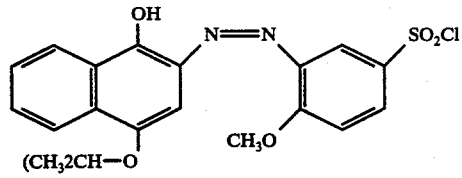

C

Preparation of
2-amino-5-hexadecylsulfonamido-1,4-dimethoxybenzene (intermediate product for compounds 1 to 3)

Stage 1: 2-acetamido-5-hexadecylsulfonamido-1,4-dimethoxybenzene 65 g of hexadecylsulfochloride are added at room temperature to a solution of 42 g of 2-acetamido-5-amino-1,4-dimethoxybenzene in 250 ml of anhydrous pyridine, and the mixture is stirred for 1 hour. After dilution with a little water, the mixture is poured out onto ice and acidified with concentrated hydrochloric acid. The deposit is filtered under suction, poured with stirring into a little acetonitrile, refiltered under suction, washed with acetonitrile and dried.

Yield: 79.4 g, Mp: 139°–140° C.

Stage 2: 2-amino-5-hexadecylsulfonamido-1,4-dimethoxybenzene 74.3 g of the product of Stage 1 are boiled under reflux with 24.8 ml of concentrated hydrochloric acid in 500 ml of ethanol until no more starting material can be detected (approximately 4 to 6 hours). The product precipitates on cooling. It is filtered under suction and dried in vacuo over potassium hydroxide.

Yield: 67 g, decomposition at about 178°–180° C.

Preparation of 2,5-diamino-1,4-didodecyloxybenzene (intermediate product for compound No. 10)

Stage 1: 2-nitro-1,4-didodecyloxybenzene 11.7 ml of nitric acid of density 1.39 are added dropwise with stirring at room temperature to a suspension of 67 g of hydroquinone diodecyl ether (described in U.S. Pat. No. 2,067,960) in 1000 ml of glacial acetic acid. The hydroquinone ether enters into solution, and its nitro compound is precipitated. After stirring overnight, the product is filtered under suction, the filtrate is concentrated in vacuo to around one-fourth of its volume, refiltered under suction and the combined filter residues are dried in vacuo over potassium hydroxide.

Yield: 69 g, Mp: 34°–36° C.

Stage 2: 2-amino-1,4-didoecyloxybenzene 24.6 g of the product of Stage 1 are catalytically hydrogenated in 200 ml of tetrahydrofuran in the presence of Raney nickel at 30°–35° C/50 atms pressure. The hydrogenation solution filtered off from the nickel is directly used for Stage 3. When concentrated by evaporation, a small sample of the solution leaves behind a solid residue melting at 54° C.

Stage 3: 2-acetamido-1,4-didodecyloxybenzene 6.3 ml of acetanhydride are added to the filtered hydrogenation solution of Stage 2 which is then left to stand for a few hours, being occasionally shaken in the meantime. The product is precipitated with 1 to 2 times the volume of acetonitrile filtered under suction and dried.

Yield: 22.8 g, Mp: 68°-69° C.

Stage 4: 5-nitro-2-acetamido-1,4-didodecyloxybenzene

The product of Stage 3 (22.8 g) is suspended in 250 ml of glacial acetic acid. 4.9 ml of nitric acid of density 1.39 are added dropwise with stirring at room temperature, the mixture becoming pasty. Following the addition of another 50 ml of glacial acetic acid, the mixture is stirred for a few hours and filtered under suction. The filtered residue is suspended twice with acetonitrile, filtered under suction and dried.

Yield: 20.5 g, Mp: 70°-71° C.

Stage 5: 5-nitro-2-amino-1,4-didodecyloxybenzene 4.6 g of the product of Stage 4 are boiled under reflux for a few hours with 1.5 ml of concentrated hydrochloric acid in ethanol until no more starting material can be detected. The mixture is then adjusted to neutral to alkaline with strong sodium hydroxide solution and precipitated with plenty of water. The deposit is filtered under suction, washed with water, stirred with acetonitrile, refiltered under suction and dried.

Yield: 4.0 g, Mp: 85°-86° C.

Stage 6: 2,5-diamino-1,4-didodecyloxybenzene

The product of Stage 5 (4.0 g) is dissolved with heating in 250 ml of ethanol and catalytically hydrogenated with Raney nickel at 50° C./50 atms pressure. Concentration of the hydrogenation solution after the nickel has been filtered off under suction gives 2.8 g of a product melting at 75°-76° C.

The dye-giving compounds according to the invention are incorporated in the casting solutions for the layers of the photographic material by any one of the usual methods. The quantity of dye-giving compound used per liter of casting solution varies within relatively wide limits, the most favourable concentration being determined by simple tests. For example, from 5 to 80 g and preferably from 20 to 40 g of dye-giving compound are used per liter of casting solution.

The association between the diffusion-resistant dye-giving compound and the silver halide required to obtain the required effect can be established, for example, by introducing the diffusion-resistant compounds into the casting solutions from aqueous-alkaline solutions using any water-solubilizing groups present. However, the non-diffusing dye-giving compounds can also be introduced into the layers by any of the known emulsifying processes. Processes of this kind are described, for example, in British patent specifications Nos. 791,219 and 1,099,414 to 1,099,417. In another embodiment, it can be desirable for example to incorporate the dye-giving compounds together with silver halide and, optionally, developer substances into the layer in the form of so-called microcapsules. In this case, two or more differently sensitized photosensitive silver halide emulsions and the corresponding diffusion-resistant compounds are also combined in a single layer in the form of so-called mixed-grain emulsions, as described, for example, in U.S. Pat. No. 2,698,794. The non-diffusing dye-giving compounds can be accommodated in a photosensitive layer itself or in an adjacent layer. For example, a compound liberating a cyan dye is associated with the red-sensitive layer, a compound liberating a magenta dye is associated with the green-sensitive layer and a compound liberating a yellow dye is associated with the blue-sensitive layer.

During development of the silver image, the dye-giving compounds according to the invention are oxidized imagewise by developer oxidation products and subsequently undergo a cleavage reaction under the effect of the developer or activator alkali, in which the dye radicals are liberated in diffusible form as dye sulfonamides. The usual photographic developer compounds can be used for development providing they are able in oxidized form to oxidize the dye-giving compounds according to the invention. The following are examples of suitable developers:

hydroquinone
N-methylaminophenol
1-phenyl-3-pyrazolidone
1-phenyl-4,4-dimethyl-3-pyrazolidone
ascorbic acid
aminophenols
N,N-diethyl-p-phenylenediamine
N-ethyl-N-hydroxyethyl-p-phenylenediamine and
3-methyl-N,N-diethyl-p-phenylenediamine It is expressly pointed out that the choice of developer substances suitable for use in the process according to the invention is not confined to color developers, but instead conventional black-and-white developers can also be used, which can be regarded as advantageous on account of their lower tendency towards discoloration. The developers can actually be present in the layers of the color photographic material where they are activated by the alkaline activator liquid, or in the alkaline processing liquid or paste.

Since the imagewise distribution of the diffusing dye liberated during development coincides with the developed silver image, it is necessary to use direct-positive silver halide emulsions or, if conventional negative emulsions are used, to apply a suitable reversal process to produce positive colored transfer images.

The silver salt diffusion process provides one such reversal process. Photographic reversal by the silver salt diffusion process for producing positive coloured images using conventional colour couplers is described, for example, in U.S. Pat. No. 2,763,800. By exchanging the color couplers for the aforementioned dye-giving compounds, it is possible to obtain a photosensitive element which is suitable for the dye diffusion transfer process. A photosensitive element of this kind comprises, for example, at least one combination of a photosensitive silver halide emulsion layer and, associated with that silver halide emulsion layer, a binder layer containing development nuclei for physical development and a dye-giving compound.

During development, the exposed part of the silver halide is chemically developed in the photosensitive silver halide emulsion layer. The unexposed part is transferred to the associated binder layer containing development nuclei by means of a silver halide solvent, and is physically developed there. In cases where physical development is carried out with a developer which, in oxidized form is capable of releasing a diffusible dye by reaction with the dye-giving compound present in that layer diffusible dyes are distributed imagewise and can be transferred to, and form a positive colored image on, an image-receiving layer.

In cases where reversal is carried out with compounds releasing development inhibitors imagewise, the photosensitive element consists of at least one layer combination of a photosensitive silver halide emulsion layer and a second emulsion layer containing the dye-giving compound which can be developed without exposure. The photosensitive silver halide emulsion layer is developed with, for example, color developers in the presence of certain compounds which release development-inhibiting substances during the reaction with oxidized color developers. The development-inhibiting substances liberated imagewise in the photosensitive layer diffuse into the adjacent emulsion layer which can be developed without exposure, where they inhibit development imagewise. In this case, the uninhibited (positive) parts of the emulsion layer which can be developed without exposure are developed by the remaining developer, the oxidation products of which subsequently react with the non-diffusing dye-giving compounds according to the invention to release diffusible dyes which are transferred imagewise to the image-receiving element. Suitable compounds which release development-inhibiting substances by reaction with color developer oxidation products are, for example, the known DIR couplers (DIR = development inhibitor releasing), which are color couplers containing a releasable inhibitor radical in the coupling position. DIR couplers of this kind are described, for example in U.S. Pat. No. 3,227,554.

Another group of compounds which release development-inhibiting substances by reaction with color developer oxidation products is described in U.S. Pat. No. 3,632,345. These compounds are not color couplers. Accordingly, no dyes are formed during release of the development-inhibiting substances. Finally, it is also possible, according to DT-PS No. 1,229,389, to use in a process of this kind suitable substituted non-diffusible hydroquinone compounds which, by reacting with developer oxidation products, are oxidized into the corresponding quinones, thereby liberating development-inhibiting mercaptans.

Suitable direct-positive silver halide emulsions are, in principle, any direct-positive silver halide emulsions of the kind which, when subjected to straightforward development produce a positive silver image and an imagewise distribution of developer oxidation products corresponding to that silver image. Examples include silver halide emulsions of the kind in which exposure or chemical treatment has produced a developable fog which can be destroyed imagewise during imagewise exposure under certain conditions. The fog remains intact at the unexposed areas, so that subsequent development gives a direct-positive silver image and, in consistency with that image, an imagewise distribution of diffusing dye when a dye-giving compound according to the invention is associated with the direct-positive silver halide emulsion.

Another group of direct-positive silver halide emulsions which can be used with advantage in the process according to the invention are the so-called unfogged direct-positive silver halide emulsions which show photosensitivity predominantly inside the silver halide grains. Imagewise exposure of these emulsions produces a latent image predominantly inside the silver halide grains. However, unfogged direct-positive silver halide emulsions of this kind are developed under fogging conditions, a fog being produced predominantly in the unexposed areas, whilst a positive silver image is developed during development. The unfogged direct-positive silver halide emulsions are distinguished by the fact that, when developed with a typical surface developer of the following composition

| | |
|---|---|
| p-hydroxyphenylglycine | 10 g |
| sodium carbonate (crystallised) | 100 g |
| make up with water to | 1000 ml |

exposed samples preferably do not give a silver image, or only produce a low-density silver image, whereas in cases where an internal developer of the following composition is used

| | |
|---|---|
| hydroquinone | 15 g |
| monomethyl-p-aminophenolsulphate | 15 g |
| sodium sulphite (anhydrous) | 50 g |
| potassium bromide | 10 g |
| sodium hydroxide | 25 g |
| sodium thiosulphate (crystallised) | 20 g |
| make up with water to | 1000 ml |

a silver image of adequate density is formed.

Selective fogging of the unfogged direct-positive emulsions which have been exposed imagewise can be carried out before or during development by treatment with a fogging agent. Suitable fogging agents are reducing agents such as hydrazine or substituted hydrazines, cf. for example U.S. Pat. No. 3,227,552.

Unfogged direct-positive emulsions are, for example those which show faults inside the silver halide grains (U.S. Pat. No. 2,592,250) or silver-halide emusions of laminar grain structure DT-OS No. 2,308,239)

In the context of the invention, the words "association" and "associated" are intended to mean that the arrangement of silver halide emulsion and dye-giving compound is such that they can interact to allow imagewise consistency between the silver image formed and the imagewise distribution of the diffusing dye liberated. The associated dye-giving compound is best incorporated in the silver halide emulsion itself or in a layer adjacent to the silver halide emulsion layer, this adjacent layer preferably lying behind the silver halide emulsion layer (looking in the direction of the incident light during exposure).

The dye diffusion transfer process according to the invention is carried out with a photosensitive element which contains one or more silver halide emulsion layers and, associated with those layers, non-diffusing dye-giving compounds, and with an image-receiving element in which the required dye image is produced by the diffusible dyes transferred imagewise. To this end, the photosensitive element and the image-receiving element must be in firm contact with one another for at least a finite period within the developing time, so that the imagewise distribution of diffusing dyes produced in the photosensitive element as a result of development can be transferred to the image-receiving element. Contact can be established after development has been started, or it can already have been established before development begins. The latter occurs, for example, where the dye diffusion transfer process is carried out with a material in which the photosensitive element and the image-receiving element from an integral unit, also referred to hereinafter as a one-sheet material, which remains intact on completion of development. In other words the photosensitive element is not separated from the image-receiving element, even after dye transfer. An embodiment of this kind is described, for example, in DT-OS No. 2,019,430.

A one-sheet material suitable for carrying out the dye diffusion transfer process according to the invention comprises, for example the following layer elements:

(1) a transparent layer substrate
(2) an image-receiving layer
(3) a light-impermeable layer
(4) a photosensitive element with at least one photosensitive silver halide emulsion layer and at least one non-diffusing dye-giving compound associated with that emulsion layer,
(5) a retarding layer
(6) an acid polymer layer
(7) a transparent layer substrate The one-sheet material can be composed in such a way that two different parts, namely the photosensitive part (layer elements 1 to 4) and the cover sheet (layer elements 5 to 7), are prepared separately from one another, subsequently placed one on top of the other (layer side) and joined together, optionally with spacer strips in between, so that a space for receiving an accurately measured quantity of a processing liquid is formed between the two parts. The layer elements 5 and 6 which together form the neutralisation system can also be arranged in the opposite sequence between the layer substrate and the image-receiving layer of the photosensitive part.

Means can be provided for introducing a processing liquid between the photosensitive part and the cover sheet, for example in the form of a laterally arranged rupturable container which under the effect of mechanical forces, releases its contents between two adjacent layers of the one-sheet material.

An important part of the photographic material according to the invention is the photosensitive element which, in the case of a one-dye transfer process, contains a photosensitive silver halide emulsion layer and, associated with this layer, a non-diffusing dye-giving compound. The non-diffusing compound can be accommodated in a layer adjacent to the silver halide emulsion layer or in the silver halide emulsion layer itself, in which case the color of the image dye is preferably selected in such a way that the predominant absorption range of the dye-giving compound does not coincide with the predominant sensitivity range of the silver halide emulsion layer. However, to produce multicolor transfer images in natural colors, the photosensitive element contains three such associations of dye-giving compound and photosensitive silver halide emulsion layer, the absorption range of the dye-giving compound generally coinciding to a large extent with the spectral sensitivity range of the associated silver halide emulsion layer. In this case, however, the dye-giving combination must be accomodated in a separate binder layer behind the silver halide emulsion layer (looking in the direction of the incident light during exposure) if high sensitivity is to be obtained.

The developer oxidation products formed during the development of a silver halide emulsion should, of course only act on the associated dye-giving compound. Accordingly, separating layers are generally present in the photosensitive element, effectively preventing the developer oxidation products from diffusing into other non-associated layers. These separating layers can contain, for example, suitable substances which react with the developer oxidation products, for example non-diffusible hydroquinone derivatives, or, if the developer is a color developer substance, non-diffusible color couplers. In one preferred embodiment, therefore, the photosensitive element has the following structure (from top to bottom):

blue-sensitive silver halide emulsion layer,
layer with non-diffusing compound capable of liberating a diffusing yellow dye,
separating layer,
green-sensitised silver halide emulsion layer,
layer with non-diffusing compound capable of liberating a diffusing magenta dye,
separating layer,
red-sensitive silver halide emulsion layer,
layer with non-diffusing compound capable of liberating a diffusing cyan dye.

The silver halide emulsion layers can, of course, also be arranged in a different order, although in this case the associated layers must also be changed together with the coloring systems so that the association remains intact.

The light-impermeable layer under the photosensitive element is permeable to aqueous alkaline treatment solutions and, hence, to the diffusing dyes. It performs essentially two functions. Firstly, it is used to mask the image silver left after development in the originally photosensitive element, and the coloring compounds left behind as color negative, so that only the positive dye transfer image is visible to the eye through the transparent layer substrate of the photosensitive part. Secondly, it shields the photosensitive element on the side of the image-receiving layer (downwards) against light, which is of particular importance in cases where, after exposure, the one-sheet material is brought into contact with the alkaline processing composition inside the camera, removed from the camera and then developed outside the camera.

Layers sufficiently impermeable to light, but sufficiently permeable to diffusible dyes can be prepared, for example, with suspensions of inorganic or organic dark, preferably black pigments, for example with suspensions of carbon black in suitable binders, for example in gelatin solutions. In general, 0.5 to 2 $\mu$ thick layers containing from 10 to 90% by weight (based on the total dry weight) of carbon black in gelatin are generally sufficient for keeping out light to an adequate extent during development. The particle size of the pigments used is not particularly critical, providing it does not exceed 0.5 $\mu$ to any appreciable extent.

In addition to the black pigment layer, the light-impermeable layer also comprises a white pigment layer below the black pigment layer. The object of this white pigment layer is to mask the black layer and to provide a white background for the image. Any white pigments can be used for the white pigment layer providing they do not have to be used in excessive layer thicknesses to provide adequate covering power. Examples of suitable white pigments include barium sulfate, oxides of zinc titanium, silicon, aluminium and zirconium and also barium stearate or kaolin. Titanium dioxide is preferably used as the white pigment. The parameters relating to binder, concentration and particle size specified in reference to the black pigments apply to the white pigments as well. The thickness of the white pigment layer can be varied according to the required whiteness of the back ground. Thicknesses of 2 to 10$\mu$ are preferably used.

Instead of the light-impermeable layer, the one-sheet material according to the invention can also contain means for producing a light-impermeable layer of this kind between the photosensitive element and the image-receiving layer, for example in the form of a laterally arranged container with a processing liquid containing an opacifying agent (pigment), which under the effect of mechanical forces releases its contents between the aforementioned layers so that a pigment layer is formed there.

The image-receiving layer consists essentially of binder-containing dye mordants for fixing the diffusing dyes.

Preferred mordants for acid dyes are long-chain quaternary ammonium or phosphonium compounds or ternary sulfonium compounds, for example those described in U.S. Pat. Nos. 3,271,147 and 3,271,148. Certain metal salts and their hydroxides which form substantially insoluble compounds with the acid dyes can also be used. The dye mordants are dispersed in the receiving layer in one of the usual hydrophilic binders, for example in gelatin, polyvinylpyrrolidone, completely or partially hydrolysed cellulose esters and the like. Some binders can, of course, also act as mordants, for example copolymers or polymer mixtures of vinylalcohol and N-vinyl-pyrrolidone of the kind described, for example, in DT-AS No. 1,130,284, and also those which represent polymers of nitrogen-containing quaternary bases, for example polymers of N-methyl-2-vinyl pyridine of the kind described, for example, in U.S. Pat. No. 2,484,430. Other suitable mordant binders are, for example, guanyl hydrazone derivatives of alkylvinyl ketone polymers of the kind described, for example in U.S. Pat. No. 2,882,156 or guanyl hydrazone derivatives of acylstyrene polymers of the kind described, for example, in DT-OS No. 2,009,498. In general, however, other binders, for example gelatin, will be added to those mordant binders.

Suitable transparent layer substrates for the one-sheet material according to the invention include the transparent substrate materials normally used in photography, for example films of cellulose esters, polyethylene terephthlate, polycarbonate or other film-forming polymers.

The alkaline processing composition produces a relatively high pH-value (about 11 to 14) in the photosensitive material, thereby initiating development and imagewise dye diffusion. It has been found that the dyes and, hence, the images obtained are not particularly stable at this high pH-value. Accordingly, the material has to be made almost completely neutral or weakly acid on completion of development. This can be achieved in known manner if the material additionally contains an acid polymer layer which becomes accessible to the alkaline processing composition only gradually during development. An acid polymer layer is a binder layer which contains polymeric compounds with acid groups, preferably sulfo or carboxyl groups. These acid groups react with the cations of the processing composition to form salts and, in doing so, lower the pH-value of the composition. The polymeric compounds and, hence, the acid groups are of course incorporated in the aforementioned layer in diffusion-resistant form. In many cases, the acid polymers represent derivatives of cellulose or derivatives of polyvinyl compounds, although other polymer compounds can also be used. Examples of suitable acid polymers include cellulose derivatives with a free carboxyl group, for example cellulose dicarboxylic acid semiesters with a free carboxyl group such as cellulose acetate hydrogen phthalate, cellulose acetate hydrogen glutarate, ethyl cellulose acetate hydrogen succinate, cellulose acetate hydrogen succinate hydrogen phthalate, ethers and esters of cellulose modified with further dicarboxylic acid anhydrides or with sulfonic acid anhydrides, for example with o-sulfobenzoic acid anhydride, carboxymethyl cellulose, and also polystyrene sulfonic acid, polyvinyl hydrogen phthalate, polyvinylacetate hydrogen phthalate, polyacrylic acid, acetals of polyvinylalcohol with aldehydes substituted by carboxy groups or sulfo groups, such as o-, m- or p-benzaldehyde sulfonic acid or carboxylic acid, partially esterified esterified ethylene/maleic acid anhydride copolymers, partially esterified methylvinyl ether/maleic acid anhydride copolymers and the like.

This acid polymer layer must contain sufficient acid groups to reduce the pH-value of the processing composition from its original level of 11 to 14 to such an extent that, ultimately, the material is almost neutral or weakly acid (pH-value 5 to 8).

The delay in the reduction of the pH-value is obtained in conventional manner by coating the acid polymer layer with a so-called retarding layer. This retarding layer is an alkali-permeable layer which preferably consists of a polymer inert to alkali, for example of polyvinyl alcohol or a partially acetalized polyvinyl alcohol. The delay in the reduction of the pH-value can be adjusted in the required manner by suitably selecting the thickness and composition of the retarding layer.

Neutralization systems, i.e. combinations of an acid polymer layer and a retarding layer, are described, for example, in DT-PS No. 1,285,310. Layer combinations of this kind can be present in the material according to the invention, for example in the photosensitive part between the transparent layer substrate and the image-receiving layer. Another possibility is to arrange the neutralization system of an acid polymer layer and a retarding layer on the cover sheet. These two layers must, of course, be arranged in such an order that the alkali of the processing composition has first to penetrate through the retarding layer to reach the acid polymer layer.

The dye diffusion transfer process according to the invention can be carried out with advantage in or by means of a suitable self-developing camera. This camera can be provided, for example, with means which, following exposure of the photosensitive element, distribute a processing solution between the photosensitive element and the cover sheet, and which shield the photosensitive material against light. A camera of this kind is preferably provided with two contacting squeezing rollers. The one-sheet material is drawn out between these, splitting open the laterally arranged container which thus discharges its contents between the layers of the one-sheet material.

Since, after passing through the squeezing rollers, the photosensitive element is protected on both sides against undesirable exposure by light-impermeable layers, the exposed material can be pulled out of the camera immediately after development has begun.

To process the one-sheet material after imagewise exposure, the photosensitive element is brought into contact with the aqueous alkaline processing solution. The silver halide emulsion layers exposed imagewise are developed in the presence of the developer compound. An imagewise distribution of oxidation products of the developer compound, which oxidizes the associated dye-giving compound, is produced in consistency with the positive silver image formed, followed by reaction with the alkali in the activator to release the diffusing dye.

EXAMPLE 1

A photosensitive element of a photographic material according to the invention was produced by successively applying the following layers to a transparent polyester-film substrate (the quantities quoted are quantities per square meter in each case).

1. an image-receiving layer of 3.8 g of octadecyl trimethyl ammonium methylsulfate and 9.5 g of gelatin
2. a reflecting layer of 48.5 g of $TiO_2$ and 4.85 g of gelatin
3. a dye layer with 0.77 g of compound 1 (yellow), 0.1 g of carbon black and 2.56 g of gelatin
4. a silver bromide emulsion layer of 3.15 g of AgBr and 2.65 g of gelatin
5. a protective layer of 1.3 g of gelatin A transparent cover sheet of cellulose acetate was applied to the uppermost layer of the photosensitive element. A rupturable container filled with an alkaline processing liquid of the following composition was used for developing the imagewise exposed photosensitive element:

20 g of sodium hydroxide
30 g of Natrosol HHR 250 (hydroxyethylcellulose)
0.5 g of phenidone
made up with water to 1000 ml.

The image set was passed through a pair of squeezing rollers which distributed the developer paste between the photosensitive element and the cover sheet. After development for 10 minutes at 20° C. the image element was separated off and freed from the paste adhering to it. A negative yellow dye image of high color quality was visible through the transparent substrate with the titanium dioxide layer as image background.

EXAMPLE 2

The procedure was as described in Example 1, except that compound 1 in layer 3 was replaced by compound 2. Processing in the same way as in Example 1 produced a negative cyan dye image of high color quality.

EXAMPLE 3

The procedure was as described in Example 1, except that compound 1 in layer 3 was replaced by compound 3. Processing in the same way as in Example 1 produced a negative magenta dye image of high color quality.

EXAMPLE 4

The procedure was as described in Example 1, except that compound 1 in layer 3 was replaced by compounds 4 to 11, 15 and 18 Processing in the same way as in Example 1 produced negative magenta dye images in each case.

EXAMPLE 5

A multilayer multicolored photosensitive recording material was produced by applying the following layers to a substrate consisting of a transparent layer substrate, layer 1 (mordant layer) and layer 2 (titanium dioxide layer) of Example 1 (the quantities quoted are quantities per square meter in each case).

3. a gelatin layer with 1 g of compound 2 (cyan) and 0.1 g of carbon black
4. a red-sensitive negative-working gelatin silver bromide emulsion of 3.15 g of AgBr and 2.65 g of gelatin
5. an intermediate layer of 0.25 g of octadecylhydroquinone sulfonic acid and 2.5 g of gelatin as blocking layer for oxidized auxiliary developer
6. a gelatin layer with 1.4 g of compound 3 (magenta)
7. a green-sensitive negative-working gelatin silver bromide emulsion of 3.15 g of AgBr and 2.65 g of gelatin
8. a blocking layer for oxidized auxiliary developer, identical with layer 5
9. a gelatin layer with 0.78 g of compound 1 (yellow)
10. a blue-sensitive negative-working gelatin silver bromide emulsion of 3.15 g of AgBr and 2.65 g of gelatin
11. a gelatin protective layer of 1.3 g of gelatin.

The photosensitive recording material was exposed using a color separation wedge and was subsequently processed as described in Example 1. A multicolored negative image of the original with good color separation and of high color quality was obtained.

EXAMPLE 6

(a) Positive-working Image Element

The following layers were applied to the same substrate (transparent support, layers 1, 2 and 3 as in Example 5):

4. A gelatin layer with a red-sensitized non-fogged direct-positive silver chloride bromide emulsion, silver covering 1.8 g
5. a blocking layer as in Example 5
6. a magenta dye layer as in Example 5
7. a gelatin layer with a green-sensitised unfogged direct-positive silver chloride bromide emulsion, silver covering 1.8 g
8. a blocking layer as in Example 5
9. a yellow dye layer as in Example 5
10. a gelatin layer with a blue-sensitised unfogged direct-positive silver chloride bromide emulsion, silver covering 1.8 g
11. a gelatin protective layer of 1.3 g of gelatin (b) A Cover Sheet Consisting of a Transparent Film of Cellulose Triacetate A strip of the image element (a) was exposed through a color separation wedge and subsequently joined on the layer side with the cover sheet (b) to form an image set through two laterally arranged spacer strips 180μ thick and 0.5 cm wide in conjunction with a bag of paste at one end of the image strip.

A paste of the following composition was used as developer:

25 g of potassium hydroxide
10 ml of benzylalcohol
5 g of N,N,N',N'-tetramethyl-p-phenylenediamine
1 g of acetylphenylhydrazine
35 g of hydroxyethyl cellulose
make up with water to 1 liter.

Processing in the same way as described in Example 1 produced a direct-positive multicolored image of the original.

EXAMPLE 7

The procedure was as described in Example 6, except that 0.8 g of compound 8 was used in layer 6 instead of 1.4 g of compound 3. The photosensitive recording material was then exposed and developed in the same way as described in Example 6. In this way, a direct-positive multicolored image of the original was obtained in the image-receiving layer as in Example 6.

EXAMPLE 8

The procedure was as described in Example 1, except that compound 1 in layer 3 was replaced by compound 12. Processing in the same way as in Example 1 produced a negative red dye image consisting of yellow and magenta dyes.

We claim:

1. A photographic material comprising on a support at least one photosensitive silver halide emulsion layer and, associated with that layer, a non-diffusible dye-giving sulfonamidoaryl compound which, on oxidation by the oxidation product of a photographic developer compound, is split by developer alkali to release a diffusible dye or dye precursor carrying a sulfonamide group, the non-diffusible sulfonamidoaryl compound corresponding to the following structural formula:

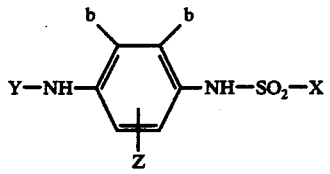

in which

X represents the radical of a dye or non-coupling dye precursor;

Y represents a $—SO_2R$ radical;

R represents an alkyl, aryl or heterocyclic group;

Z represents hydrogen or one or more identical or different substituents selected from the group consisting of alkyl, alkoxy, mono- or dialkylamino, aryl, aroxy and acylamino; and

*b* represents hydrogen or one or more identical or different substituents selected from the group consisting of alkyl, alkoxy, mono- or dialkylamino, aryl, aroxy and acylamino; or the two radicals b together represent the radical required to complete a fused aromatic ring system, and the released diffusible dye has a sulfamoyl group formed from the sulfonamide group of said structural formula.

2. A photographic material comprising on a support at least one photosensitive silver halide emulsion layer and, associated with that layer, a non-diffusible dye-giving sulfonamidoaryl compound which, on oxidation by the oxidation product of a photographic developer compound, is split by developer alkali to release a diffusible dye or dye precursor carrying a sulfonamide group, the non-diffusible sulfonamidoaryl compound corresponding to the following formula:

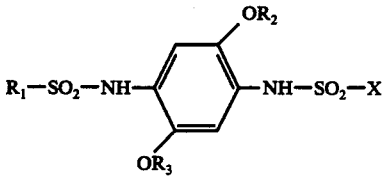

in which

X represents the radical of a dye or dye precursor;

$R_1$ represents a diffusion-inhibiting radical or the radical of a dye or dye precursor; and $R_2$ and $R_3$ represent identical or different alkyl radicals with up to 20 carbon atoms.

3. A photographic diffusion transfer process for producing colored images by exposing a photographic material comprising on a support at least one photosensitive silver halide emulsion layer and, associated with that layer, a non-diffusible dye-giving sulfonamidoaryl compound which, on oxidation by the oxidation product of a photographic developer compound, is split by developer alkali to release a diffusible dye or dye precursor carrying a sulfonamide group, the non-diffusible sulfonamidoaryl compound corresponding to the following structural formula:

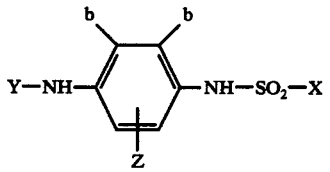

in which

X represents the radical of a dye or non-coupling dye precursor;

Y represents a $—SO_2R$ radical;

R represents an alkyl, aryl or heterocyclic group;

Z represents hydrogen or one or more identical or different substituents selected from the group consisting of alkyl, alkoxy, mono- or dialkylamino, aryl, aroxy and acylamino; and

*b* represents hydrogen or one or more identical or different substituents selected from the group consisting of alkyl, alkoxy, mono- or dialkylamino, aryl, aroxy and acylamino, or the two radicals b together represent the radical required to complete a fused aromatic ring system, and developing said exposed photographic material at a pH of from 11 to 14 in the presence of a non-coupling black and white developer compound including the steps of reducing the exposed silver halide with said developer compound to oxidize said developer compound, oxidizing the sulfonamidoaryl compound with said oxidized developer compound, splitting the oxidized sulfonamidoaryl compound by the developer alkali to release a diffusible dye from said compound, having a sulfamoyl group formed from the sulfonamide group of said structural formula and transferring said diffusible dye to an image receiving element.

* * * * *

UNITED STATES PATENT AND TRADEMARK OFFICE

CERTIFICATE OF CORRECTION

PATENT NO. : 4,110,113

DATED : August 29, 1978

INVENTOR(S) : Melzer et al

It is certified that error appears in the above-identified patent and that said Letters Patent are hereby corrected as shown below:

Column 2, line 63, "of" should be --or--;

Column 7, compound 16, in the ring at the left side of the second structural formula a bond line should be added at the upper left side so that the ring appears as follows:

$X^4$ = 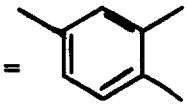

Column 7, compound 17, at the right side of the structural formula, -- $-X_5$ should be added to the right side of the formula so that it appears as follows:

$$-NH - SO_2 - X_5$$

Column 8, compound 18, at the right side of the structural formula, -- $X_6$ should be added so that the right side of the formula reads as follows:

$$-NH - SO_2 - X_6$$

Column 9, the formula of C should have the numeral "2" at the leftmost ($CH_3$) shown as a subscript to appear as follows:

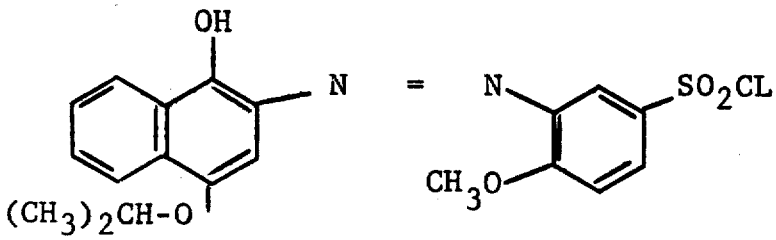

UNITED STATES PATENT AND TRADEMARK OFFICE

CERTIFICATE OF CORRECTION

PATENT NO. : 4,110,113

DATED : August 29, 1978

INVENTOR(S) : Melzer et al

It is certified that error appears in the above-identified patent and that said Letters Patent are hereby corrected as shown below:

Column 10, line 17, "diodecyl" should be --didodecyl--;

Column 10, line 57, "didoecyloxybenzene" should be --didodecyloxybenzene--;

Column 14, line 30, "emusions" should be --emulsions--;

Column 14, line 62, "from" should be --form--;

Column 17, line 39, "terephthlate" should be --terephthalate--;

Column 18, line 10, delete "esterified" second occurrence.

Signed and Sealed this

*Fifteenth* Day of *July 1980*

[SEAL]

*Attest:*

SIDNEY A. DIAMOND

*Attesting Officer*

*Commissioner of Patents and Trademarks*